US008082971B1

(12) United States Patent
Peterson et al.

(10) Patent No.: US 8,082,971 B1
(45) Date of Patent: Dec. 27, 2011

(54) PORTABLE PARTITION SYSTEM HAVING MODULAR FRAMES, BARS, AND FRICTION FIT SPACERS

(76) Inventors: Julie M. Peterson, Maple Lake, MN (US); Brendan J. Mooney, Saint Cloud, MN (US)

( * ) Notice: Subject to any disclaimer, the term of this patent is extended or adjusted under 35 U.S.C. 154(b) by 48 days.

(21) Appl. No.: 12/605,282

(22) Filed: Oct. 23, 2009

Related U.S. Application Data

(60) Provisional application No. 61/197,447, filed on Oct. 28, 2008.

(51) Int. Cl.
*A47G 5/00* (2006.01)

(52) U.S. Cl. ..... 160/135; 40/606.16

(58) Field of Classification Search ..... 160/135, 160/351, 352; 52/239; 40/605, 606.16
See application file for complete search history.

(56) References Cited

U.S. PATENT DOCUMENTS

| | | | | | |
|---|---|---|---|---|---|
| 381,342 | A | | 4/1888 | De Land | |
| 846,531 | A | * | 3/1907 | Viets | 40/606.16 |
| 1,080,317 | A | | 12/1913 | Beckwith | |
| 1,093,119 | A | * | 4/1914 | Donavan | 160/135 |
| 2,012,385 | A | | 8/1935 | Gearing | |
| 2,145,030 | A | * | 1/1939 | David | 40/605 |
| 2,268,669 | A | * | 1/1942 | Moore | 160/229.1 |
| 2,573,156 | A | * | 10/1951 | Meyer | 160/378 |
| 3,037,593 | A | * | 6/1962 | Webster | 52/476 |
| 3,224,489 | A | * | 12/1965 | Haberthier | 160/135 |
| 3,370,389 | A | * | 2/1968 | Macaluso | 52/239 |
| 3,477,492 | A | * | 11/1969 | Suess | 160/135 |
| 3,509,673 | A | | 5/1970 | Witkosky et al. | |
| 3,592,289 | A | | 7/1971 | Aysta et al. | |
| 4,118,903 | A | * | 10/1978 | Coulthard | 160/351 |
| 4,467,854 | A | | 8/1984 | Godfrey | |
| 4,830,080 | A | * | 5/1989 | Densen | 160/135 |
| 4,876,835 | A | | 10/1989 | Kelley et al. | |
| 4,879,854 | A | * | 11/1989 | Handler | 52/238.1 |
| 4,977,696 | A | | 12/1990 | Johansson | |
| 5,038,539 | A | | 8/1991 | Kelley et al. | |
| 5,088,250 | A | * | 2/1992 | DeLong et al. | 52/239 |
| 5,143,138 | A | | 9/1992 | Zwart | |
| 5,172,504 | A | * | 12/1992 | De Maat et al. | 40/605 |
| 5,291,700 | A | * | 3/1994 | Chew | 52/36.1 |

(Continued)

OTHER PUBLICATIONS

"Wood Shoe Racks, Book Shelves—Home & Office Organizing", HTTP://www.shelfexpressions.com/additionalshelving.htm, Shelf Expressions, Oct. 16, 2009, 2 pages.

(Continued)

*Primary Examiner* — David Purol
(74) *Attorney, Agent, or Firm* — Albert W. Watkins

(57) ABSTRACT

A portable partition system for dividing spaces and which can easily be changed in appearance, function and size has at least one frame that includes interior grooves suitable for receiving rigid or flaccid panels. More frames may be connected with lift-off or removable pin hinge sections, which allows a user to add to or remove rigid rectangular frames from the system by simply inserting or removing hinge pins. Dowels may suspend fabric panels, or rigid flat panels may be slid down through an opening at the top of and into each frame along with removable bars to create a structure notably different in appearance or purpose. All of the components, including dowels, fabric panels, flat panels, and horizontal bars, are insertable into the rigid rectangular frames and are removable, reversible and replaceable at will and without tools to achieve many different visual effects using the same set of frames.

16 Claims, 6 Drawing Sheets

U.S. PATENT DOCUMENTS

| | | | | |
|---|---|---|---|---|
| D357,175 | S | 4/1995 | Godfrey | |
| 5,448,863 | A | 9/1995 | Zapf | |
| 5,450,694 | A * | 9/1995 | Goranson et al. | 52/71 |
| 5,626,926 | A * | 5/1997 | Roberts | 428/14 |
| D393,951 | S | 5/1998 | Ravenscroft | |
| 5,803,146 | A * | 9/1998 | Boon | 160/135 |
| 5,875,596 | A * | 3/1999 | Muller | 52/239 |
| 6,598,649 | B1 * | 7/2003 | Moore et al. | 160/135 |
| 7,387,151 | B1 | 6/2008 | Payne | |

OTHER PUBLICATIONS

"Pop Up Exhibits, Sign Frames, Stands, Custom Si . . .", http://www.godfreygroup.com/banner-stands-and-sign-displays/banner-stands-and-small-displays-5.php, The Godfrey Group, Dec. 10, 2007, 5 pages.

* cited by examiner

PORTABLE PARTITION SYSTEM HAVING MODULAR FRAMES, BARS, AND FRICTION FIT SPACERS

CROSS REFERENCE TO RELATED APPLICATIONS

This application claims priority to U.S. Provisional Patent 61/197,447 filed Oct. 28, 2008 and naming the present inventors, the contents which are incorporated herein by reference in entirety.

BACKGROUND OF THE INVENTION

1. Field of the Invention

This invention pertains generally to portable partitions, and more particularly to such partitions intended for use in decorating and design. In one manifestation, the invention pertains to lightweight, modular, partitions which are comprised of one or more smaller units with interchangeable components.

2. Description of the Related Art

Portable partitions can present enormous versatility in designing for both decorative and utilitarian function. As is well understood in the field of design, structural components such as walls, windows, doorways and the like are not easily altered. Quite simply, it is very arduous, messy and expensive to move a structure such as a wall. Furthermore, structural components are relatively limited in terms of customization options. The surface finish may be changed, and small or lightweight items may be adhered to the surface, such as stencils, photographs, posters or the like. However, even changing the surface finish is relatively disruptive, requiring the application of paint, paneling, or the like. These changes often require or may quite preferably be performed by a skilled service provider such as a carpenter or painter, and also still require significant time. As a result, most occupants rarely will undertake making any substantive decorative changes to the structural aspects of a static space.

Rather than alter the static components, alternatives have been developed that permit more ready changes to an occupied space. For exemplary purposes, some of these alternatives are illustrated in the following U.S. patents, the contents and teachings of each which are incorporated herein by reference: U.S. Pat. No. 381,342 by De Land, entitled "Bulletin board"; U.S. Pat. No. 1,080,317 by Beckwith, entitled "Display sign holder"; U.S. Pat. No. 1,093,119 by Donavan, entitled "Collapsible screen and rack"; U.S. Pat. No. 2,012,385 by Gearing, entitled "Interchangeable panel sign"; U.S. Pat. No. 2,573,156 by Meyer, entitled "Screen with removable panel"; U.S. Pat. No. 3,509,673 by Witkosky et al, entitled "Modular partition wall system"; U.S. Pat. No. 3,592,289 by Aysta et al, entitled "Freestanding acoustical space divider"; U.S. Pat. No. 4,467,854 by Godfrey, entitled "Connector for display systems"; U.S. Pat. No. 4,876,835 by Kelley et al, entitled "Work space management system"; U.S. Pat. No. 4,977,696 by Johansson, entitled "Display rack"; U.S. Pat. No. 5,038,539 by Kelley et al, entitled "Work space management system"; U.S. Pat. No. 5,143,138 by Zwart, entitled "Screen molding"; U.S. Pat. No. 5,448,863 by Zapf, entitled "Covered wall unit and method of making same"; U.S. Pat. No. 7,387,151 by Payne, entitled "Cabinet door with changeable decorative panel"; Des 357,175 by Godfrey, entitled "Connector for display stands"; and Des 393,951 by Ravenscroft, entitled "Household screen".

The more relevant of these foregoing alternatives are often referred to as screens, panels, or partitions, each of which for the purposes of the present disclosure will be simply referred to and understood herein to be partitions. These more relevant patents are exemplary of, illustrate and describe a wide variety of partitions that can readily be used to divide a larger space, display personal objects, and readily alter a building space. Some of these provide apparatus which can be used to accomplish this with limited use of or completely without the use of tools. As a result, partitions have become very commonplace in larger occupied spaces where it is desirable to preserve the space for alternative uses, while subdividing flexibility. For exemplary purposes only, and certainly not limited thereto, partitions are found in studio apartments or rooms where they are used to divide the living space, businesses where workers are divided into individual working areas or cubicles, for displays of personal or business information, in dining establishments forming smaller and more cozy spaces while preserving a larger structural space for much large special events and gatherings, and for many, many other applications.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a portable partition system which is readily adaptable in appearance and function. A first longitudinally extensive upright has a longitudinally extensive groove therein. A second longitudinally extensive upright has a longitudinally extensive groove therein. The first and second uprights are spaced from each other and oriented with the second upright groove facing the first upright groove and defining a panel space therebetween into which a decorative panel may be operatively inserted. A first spacer is at least partially inserted within and manually removable from the first upright groove. A second spacer is at least partially inserted within and manually removable from the second upright groove. A support bar spans from the first upright to the second upright and is manually removable therefrom, supported vertically by the first and second spacers.

In a second manifestation, the invention is a partition system. A first longitudinally extensive upright has a longitudinally extensive groove therein. A second longitudinally extensive upright has a longitudinally extensive groove therein. The first and second uprights are spaced from each other and oriented with the second upright groove facing the first upright groove and defining a panel space therebetween into which a decorative panel may be operatively inserted. A first spacer is at least partially inserted within and manually removable from the first upright groove. A second spacer is at least partially inserted within and manually removable from the second upright groove. A first support bar spans from the first upright to the second upright and is manually removable therefrom, supported vertically by the first and second spacers, and has at least one longitudinally extensive groove that cooperates with the first upright groove and second upright groove to receive a rigid generally rectangular panel therein. A third longitudinally extensive upright has a longitudinally extensive groove therein. A fourth longitudinally extensive upright has a longitudinally extensive groove therein, the third and fourth uprights spaced from each other and oriented with the fourth upright groove facing the third upright groove and defining a panel space therebetween into which a decorative panel may be operatively inserted. A third spacer is at least partially inserted within and manually removable from the third upright groove. A fourth spacer is at least partially inserted within and manually removable from the fourth upright groove. A second support bar longitudinally extends from the third upright to fourth upright and is manually removable therefrom, supported vertically by the third and fourth spacers, and has at least one longitudinally extensive groove that cooperates with the third upright groove and fourth upright groove to receive a rigid generally rectangular panel therein. A hinge pivotally couples the third upright to first upright. A shelf engages and is supported within the first and second support bar grooves.

OBJECTS OF THE INVENTION

Exemplary embodiments of the present invention solve inadequacies of the prior art by providing rigid modular frames having bars and friction fit spacers that allow the frames to support and display very diverse articles at readily altered heights and positions. The articles, which may include fabric panels, flat panels, shelving, are removable, reversible and replaceable in a matter of a few seconds in a simple and intuitively obvious manner. The result is a portable divider that can easily be changed in appearance, function and size by most anyone, without the use of tools, and which can incorporate a much wider variety of displays than heretofore reasonably possible.

A first object of the invention is to provide a portable and modular partition which may be transported and placed or located easily and at will. A second object of the invention is to enable customization of the partitions without the use of tools, through very simple mechanical actions which are intuitive. Another object of the present invention is to accommodate many diverse articles that may be used for function, display or to otherwise alter the appearance or function of a space. A further object of the invention is to achieve the foregoing objectives in an easily manufactured, relatively low cost and durable construction. Yet another object of the present invention is to provide a stable and secure method for both anchoring and expanding the partitions, where required.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
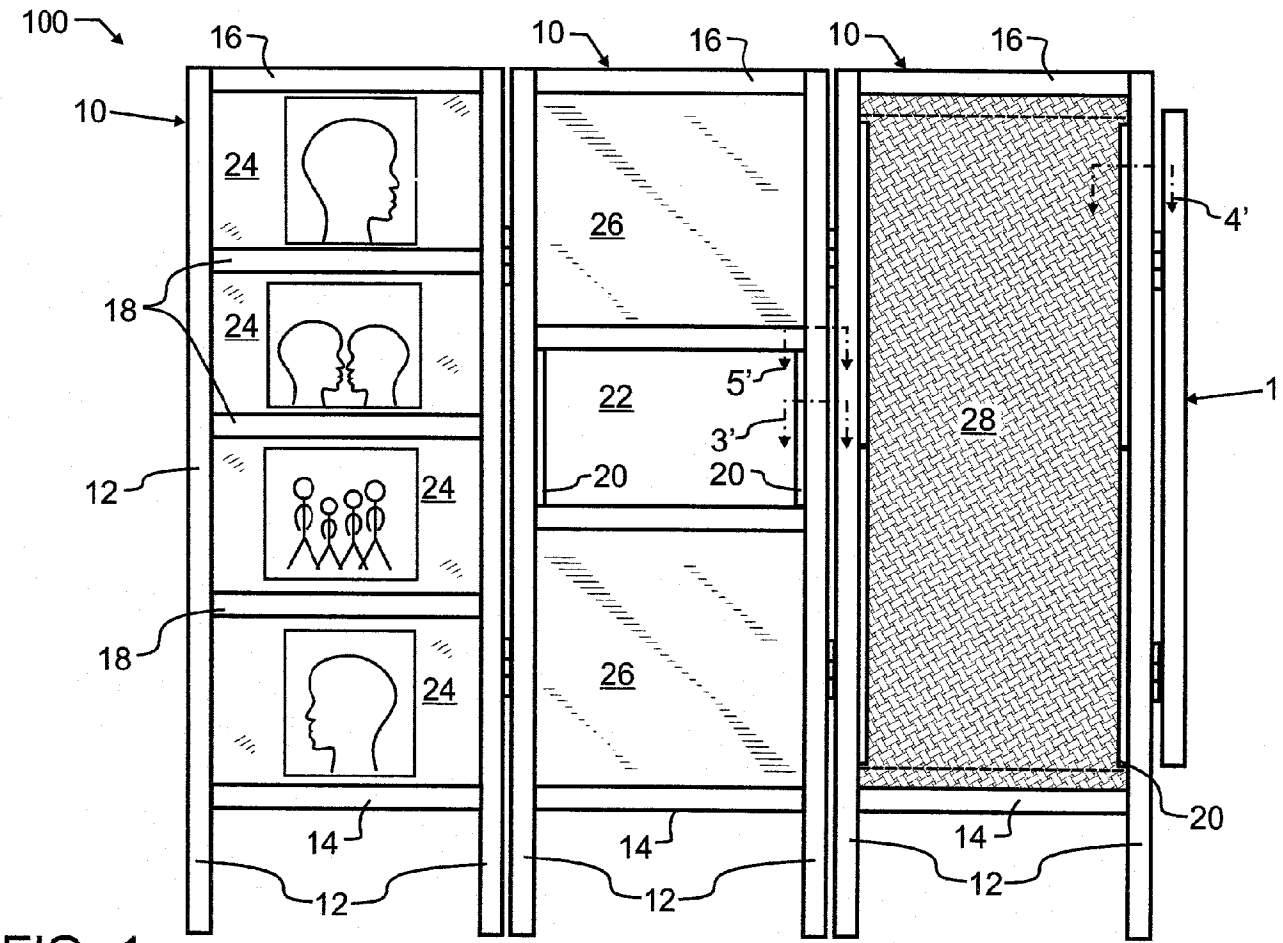
FIGS. 1 and 2 illustrate a preferred embodiment designed in accord with the teachings of the invention from front and top plan view, respectively.

Manifested in the preferred embodiment, the present invention provides a portable partition system 100 comprised of interchangeable panels 22, 24, 26, 28, modular frames 10, support bars 18, and friction fit spacers 20. In a preferred embodiment of the invention illustrated in FIGS. 1 and 2, the modular frames 10 have two removable pin hinge sections on each edge to be connected. When interconnected, these removable pin hinge sections form a removable pin hinge 9 similar to that found on nearly all interior household doors. These removable pin hinges 9 allow modular frames 10 to be added to or removed easily from portable partition system 100 without the use of tools. Such a method allows one to readily increase or decrease the width of system 100 as needed or desired. Each modular frame 10 provides the basic structure and determines the height of the completed structure. Each modular frame 10 is preferably sturdy and in the preferred embodiment non-collapsible, even when no panels or removable horizontal bars are inserted. Those skilled in the art will recognize that there may be applications where modular frames 10 will instead be collapsible, and that such may readily be achieved with any of the variety of known fasteners upon a review of the present disclosure, but that a collapsible frame then includes more complexity and cost which is less preferred herein. When the various components are added, portable partition system 100 is sturdy and portable.

Modular frames 10 may be used individually, alternatively arranged at angles to create a freestanding partition or display area, or, when interconnected, pulled open to be arranged co-planarly along a line. When arranged in co-planar fashion, portable partition system 100 will preferably be fastened at one end to a wall or other unmovable structure to keep portable partition system 100 from falling over. Most preferably, wall mount 1 is connected with two hinges 9 as well, allowing for portable partition system 100 to be removed from the wall and moved into storage when not in use. In the preferred embodiment of the invention, wall mount 1 is semi-permanently adhered to a wall using fasteners such as, but not limited to, screws, nails or adhesives. Where hardware such as screws or nails are used, matching caps can cover and conceal the fasteners.

Figure 2:
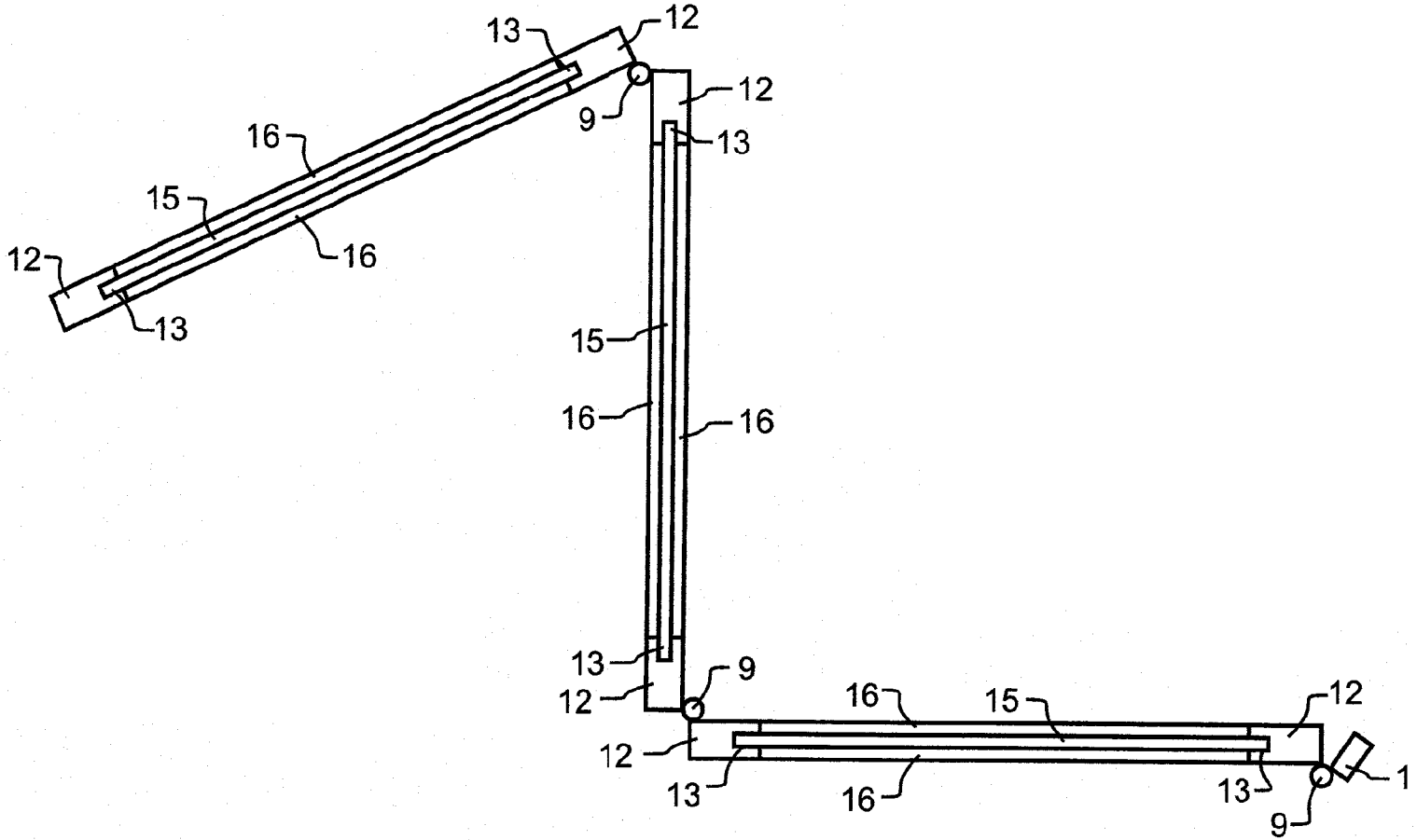

Additionally, as illustrated in FIGS. 1 and 2, removable pin hinges 9 can be on alternating sides or all on the same side. Alternating sides allows for a zig-zag pattern, whereas having the removable pin hinges 9 on one side allows for readily creating a circular area within a room, which can be desirable when creating a work space or otherwise breaking up a room.

FIGS. 1 and 2 further illustrate that there is a continuous, straight, longitudinal groove 13 along the inside of each upright 12, and a corresponding groove along the inside (top) of the crossbar 14 at the bottom of the modular frame 10. At the top of the modular frame 10 are two horizontal bars 16 that are parallel to each other with a space 15 between them to allow the insertion of generally planar webs, or panels including flaccid, semi-flexible, or rigid material into the grooves 13 of frame 10 by sliding the interchangeable panels 24, 26, 28 through opening or space 15 at the top. The user may choose from a variety of interchangeable panels to insert, differing in height, decorative appearance or function, allowing the user to determine the appearance and function of the partition. Panels 24, 26, 28 may be separated by removable support bars 18, allowing for various indeterminate height panels to be used. Preferred embodiment support bars 18 have grooves 17 running across the top and bottom of the bar, to securely hold the top or bottom edge of an inserted panel. The support bars 18 also have tenons 19 at each end which are inserted into the vertical grooves 13 in both interior sides of the modular frame 10. For exemplary purposes only, and not limiting thereto, a user will place support bar 18 by inserting a tenon 19 at one end of support bar 18 into a groove 13, holding the support bar 18 at an angle. The user then applies downward pressure to the end angled upward, lining the opposing tenon 19 up with the opposing groove 13, thereby placing the support bar 18 horizontally in the modular frame 10. The support bar 18 can be slid up or down while held in the grooves 13. If the panels are rigid, they will hold support bar 18 at a fixed vertical position. However, modular frames 10 also can hold less rigid interchangeable panels 28, such as fabric, posters, pictures, mesh, or screen. In such instances, a user simply inserts friction fit spacers 20 in combination with flaccid panels 28 into vertical grooves 13 and the horizontal grooves in support bars 18 and/or crossbars 14, 16. The friction fit spacers will thereby hold the less rigid interchangeable panels 28 in place, providing a reasonably taut panel, while providing a spacer for support bars 18. If desired, a user may also start by wrapping the flexible or flaccid panel material 28 about a dowel, stick or other member, which may then extend between grooves 13 similar to support bars 18. In such instance, only vertically oriented friction fit spacers 20 are required, such as illustrated in FIG. 1. Better understanding of the wrapping of a flaccid or flexible panel about a dowel, rod or other rigid member may be obtained from the Payne, Donovan, Meyer and other patents incorporated by reference herein above. Similarly, one may choose to use friction fit spacers 20 in combination with support bars 18 to create an open panel 22, as illustrated in FIG. 1.

Figure 3:
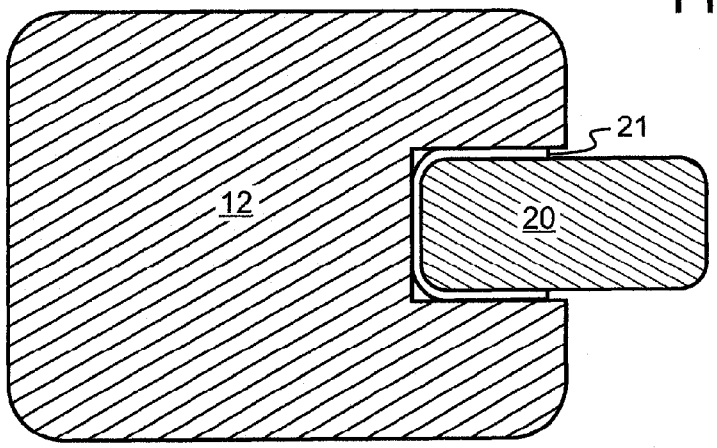
FIGS. 3 and 4 illustrate the preferred engagement of preferred friction fit spacers with the frame without and with a flexible and thin panel, respectively from a cross-section view taken along section line 3' of FIG. 1 for FIG. 3, and section line 4' of FIG. 1 for FIG. 4.
Figure 4:
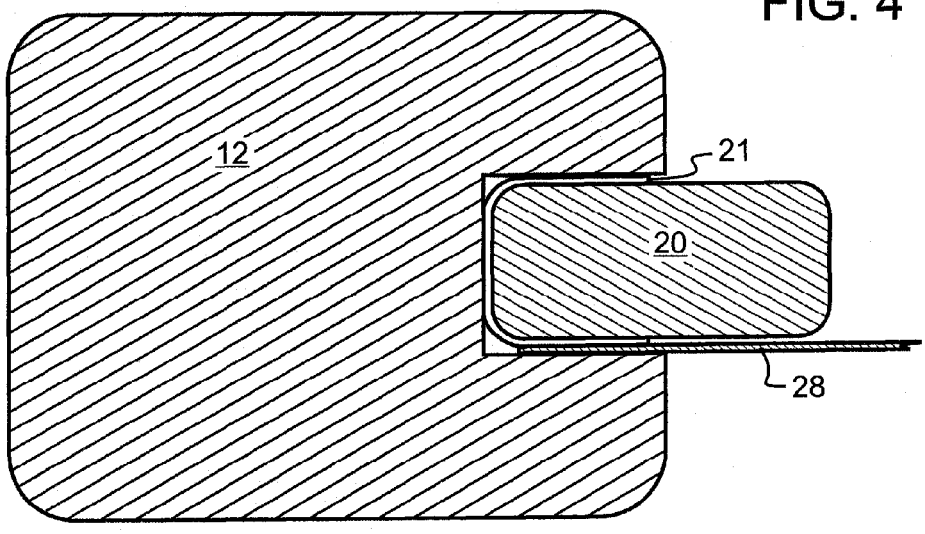

FIGS. 3 and 4 illustrate in more detail the preferred connection between friction fit spacers 20 and uprights 12. As can be seen, friction fit spacers 20 slide into the groove 13 with a small space remaining. In the case of an open panel 22, friction fit spacers 20 may preferably be provided with a small patch of material 21 which provides the remaining amount of friction necessary to hold the spacers 20 in place. However, adding the less rigid interchangeable panels 28 would be sufficient to do so as well, which requires a sufficiently small and resilient patch of material such that it does not interfere with use in combination with less rigid interchangeable panels 28. In the preferred embodiment, patch 21 is fabricated from the fabric or loop portion of commercial hook-and-loop material such as is sold under the well-known trademark Velcro, though a variety of other materials may be recognized as suitable as well. This loop material offers several benefits that may not be apparent at first blush, including resilience, a composition and construction which tends not to damage relatively delicate fabrics that might be used as panels 28, and since the individual loops may individually compress, a relative ease with which the patch 21 may be inserted and withdrawn from within a groove compared to contiguous materials such as foams or rubbers.

Figure 5:
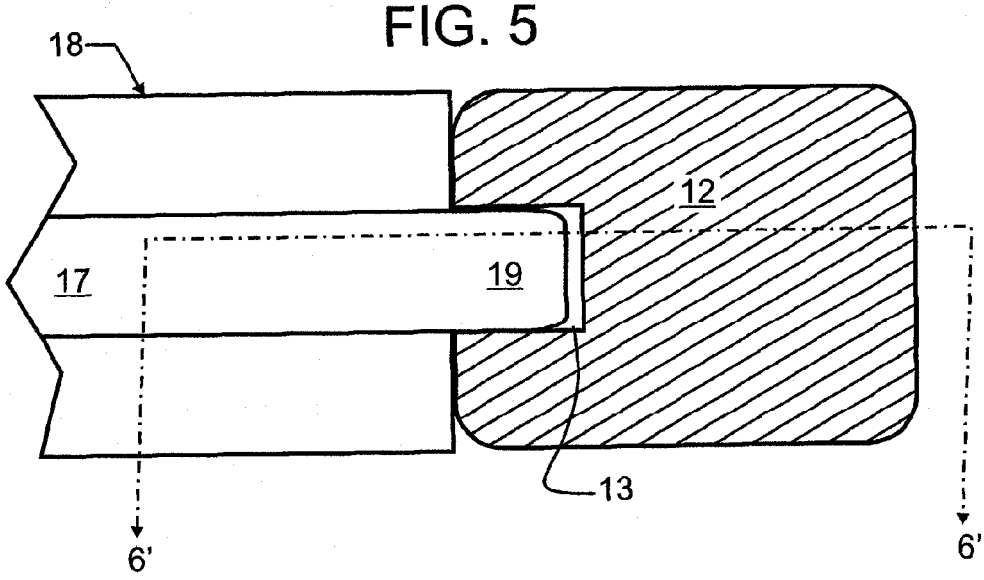
FIG. 5 illustrates the preferred engagement of the support bars with the frame from an exploded cross-section view taken along section line 5' of FIG. 1.
Figure 6:
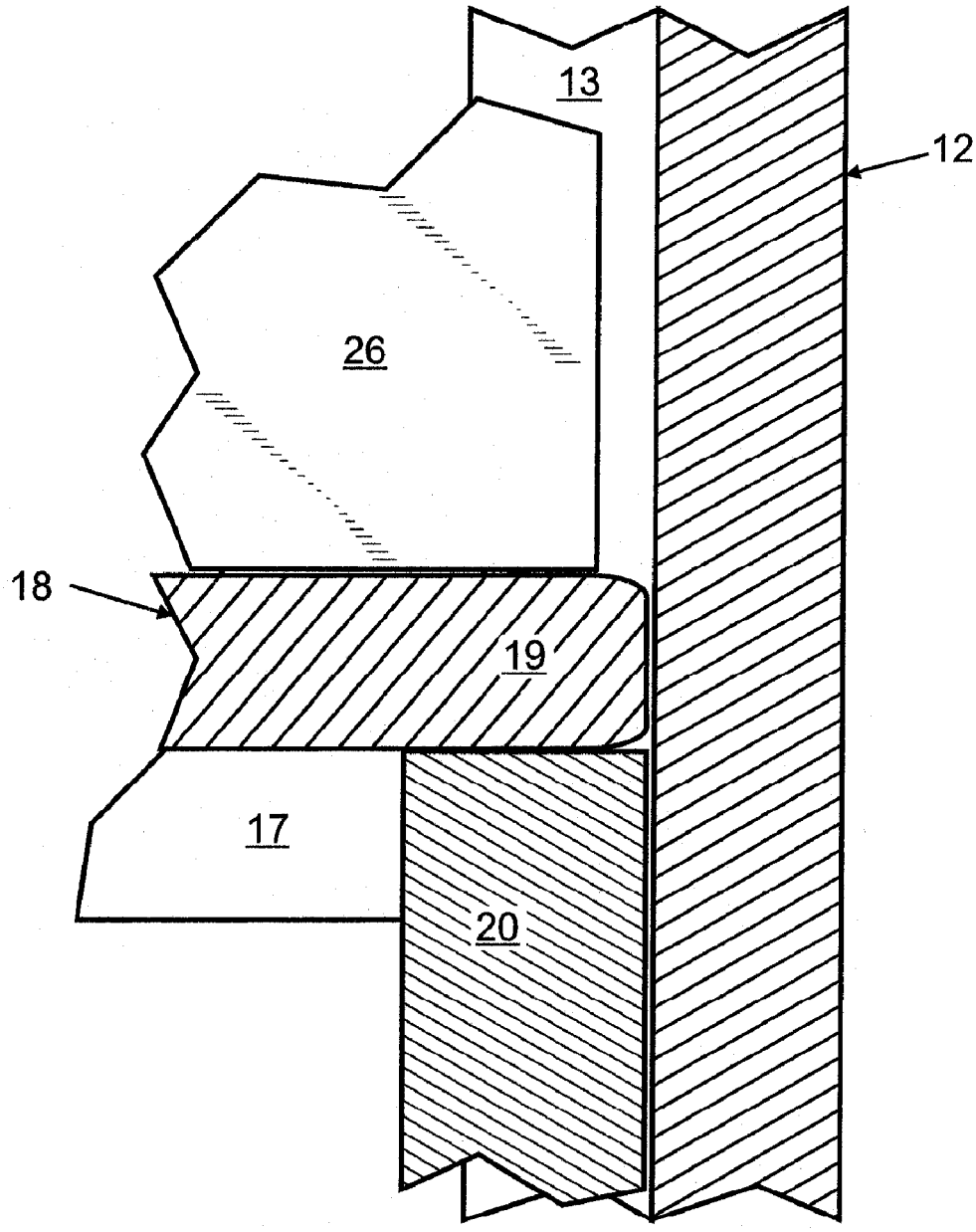
FIG. 6 illustrates the preferred engagement of FIG. 5 from a further cross-section view taken along section line 5', illustrating a support bar, frame member, thin panel, and friction fit spacer.

FIGS. 5 and 6 illustrates the combination of a support bar 18 with upright 12. As can be seen, in the preferred embodiment, tenon 19 may be designed to span the distance between top and bottom grooves 17, and extends therefrom for engagement with groove 13. Similar to friction fit spacers 20, tenon 19 is sized to form a reasonably secure engagement with groove 13. As can be further seen, friction fit spacers 20 and rigid interchangeable panels 24, 26 each may preferably be designed to be capable of engaging with groove 17 of support bars 18 in such a manner that they are sufficiently framed by support bars 18.

Figure 7:
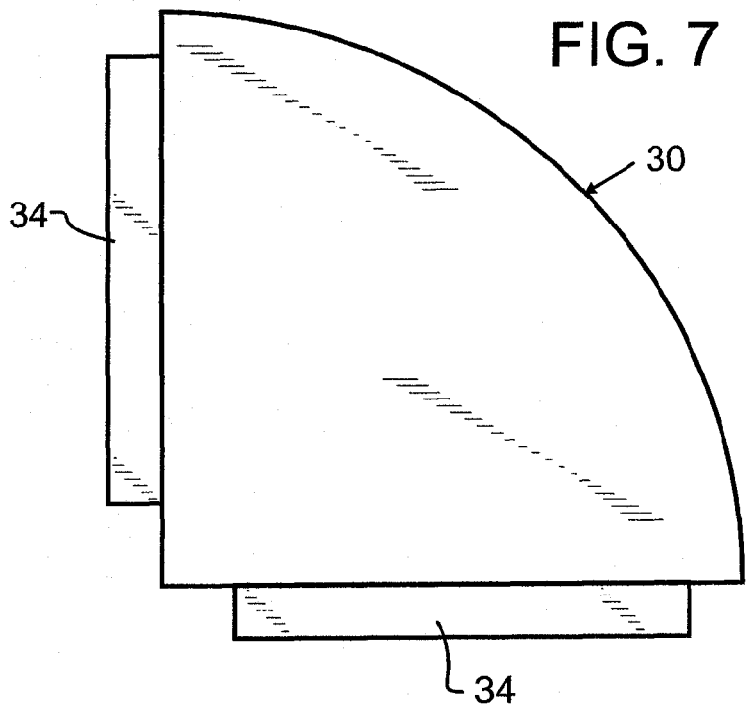
FIG. 7 illustrates a preferred embodiment shelf from top plan view.

FIG. 7 illustrates a preferred shelf 30 that may be used in combination with portable partition system 100. Preferred embodiment shelf 30 is designed for use with portable partition system 100 when modular frames 10 may be held at a predetermined angle to one another. The predetermined angle may vary, allowing for a variety of corners for the shelf 30. For example, as illustrated in the figures shelf 30 spans a quarter circle, or through a ninety-degree arc. The actual extent of arc may be chosen by a designer at the time of construction of the shelf, is not limited to ninety degrees, and may arc through more or less than ninety degrees as may be desired by the designer. Most preferably, shelf 30 has a thin hook 34 defining two radially extending edges. Hooks 34 form a preferred angle for interaction with and coupling to crossbars 14, 16 and/or support bars 18. The outer, circumferential edge of shelf 30 is defined by a lip 32 that is most preferably rounded, though it could take on a number of geometries as determined at the time of design to be aesthetically and functionally pleasing, and is not to be limited to one or another geometry. Additionally, shelf 30 while shown as solid may alternatively be porous, transparent, or take on any other characteristics that a designer wishes to impart therein.

Figure 9:
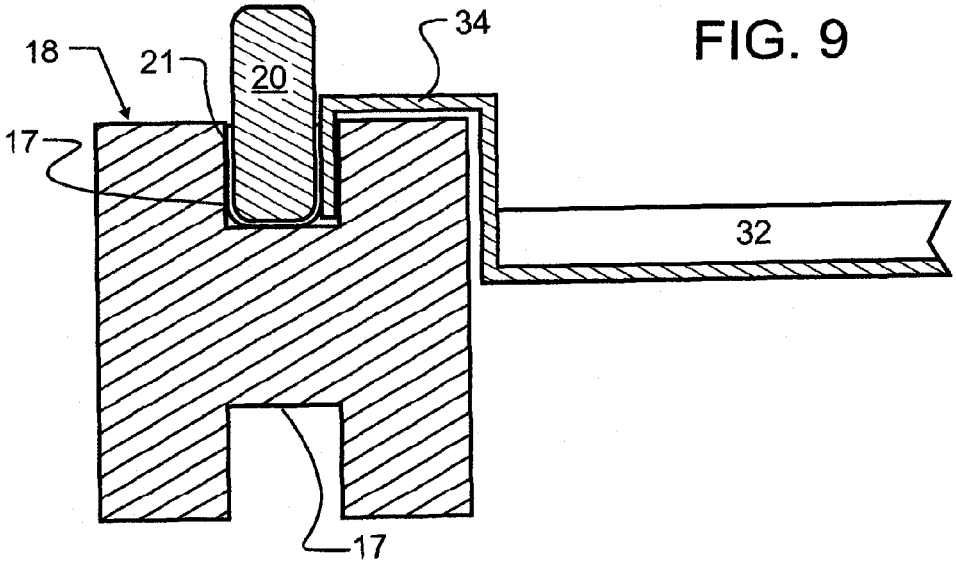
FIGS. 8 and 9 illustrate the preferred embodiment shelf of FIG. 7 in a most preferred further combination with the preferred embodiment of FIG. 1 from top plan and cross-section views, respectively.
Figure 8:
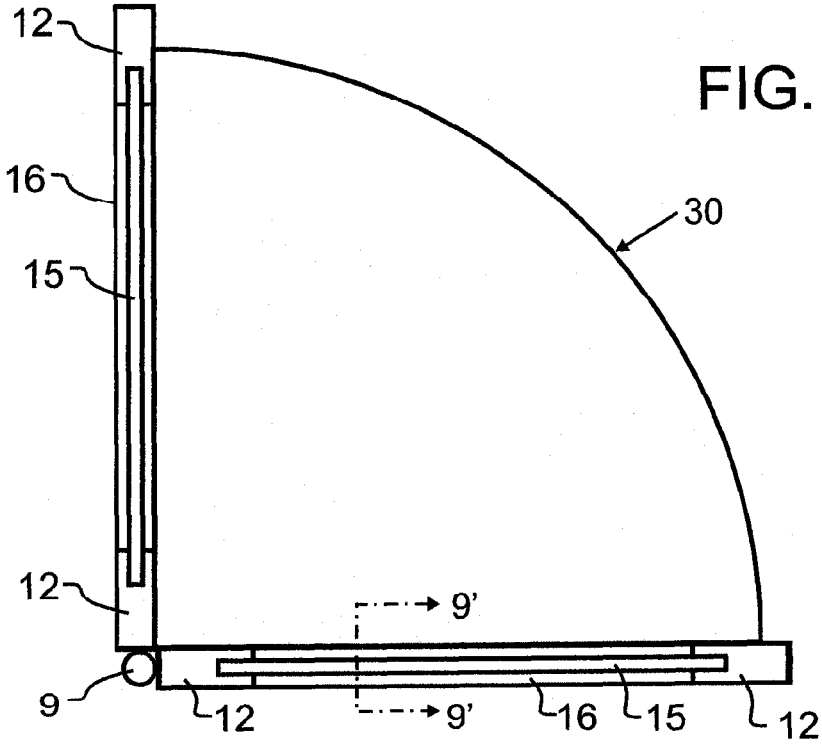

As can be seen in FIGS. 8 and 9, hooks 34 engage with crossbars 14, 16 and/or support bars 18 in such a manner that they engage and anchor into groove 13, 15, or 17. This allows for the preferred embodiment shelf 30 to hold items for display, or needing sunlight, such as a plant or fish tank, with a blank space 22 created using friction fit spacers 20 or with a partition panel using an interchangeable panel 24, 26, 28, as may be desired. In the illustration of FIG. 9, a friction fit spacer 20 is illustrated, though it will be recognized that a panel 24, 26, 28 may also or alternatively be provided. Furthermore, and while not separately illustrated, it will be apparent that a continuously connected (through hinges 9) six, seven or eight frame portable partition system 100 may be used to completely form a circle, using four ninety degree shelves 30. Alternatively, and using the same four ninety degree shelves 30 with only two portable partition systems 100, each of only two frames, an entire circle may also be spanned. With the present design, the shelves do not need to be at the same elevation above the ground, and may instead be at different heights around the full 360 degree circle. Of course, more shelves than the four may also be provided, and at various elevations as well.

From these figures and the description, several additional features and options become more apparent. First of all, modular frames 10 may be made from any variety of sufficiently lightweight, durable, and sturdy materials, including resins and plastics, metals, wood, cementitious materials, or even combinations of the above. The specific material used may vary, though special benefits are attainable if several important factors are taken into consideration. First, modular frames 10 should be sufficiently light to enable even a relatively small or frail person to safely move or set up portable partition system 100. Most preferably, modular frames 10 will also be sufficiently durable to withstand repeated set up and adjustment in addition to any forces that may be applied that could tend to tear, fracture, or penetrate the material. Additionally, resistance to abrasion from such contact as would be found during set up and storage would be preferable. Similarly, uprights 118 and crossbars 113, 115, 119 may also be made from any sufficiently sturdy, lightweight, and durable material.

Because all panels 24, 26, 28 are visible on both sides (front and back) of the partition 100, they may have a different decorative or functional finish on either side, increasing the variety of choices for the user. Where individual panels are sufficiently thin, two or more may be inserted within the same space, permitting photographs or other precious objects to be captured between two pieces of acrylic, for exemplary purposes. The interchangeable panels 24, 26, 28 can also be used as wall decor when not being used in combination with the modular frame 10. Several designs have been contemplated for the interchangeable panels 24, 26, 28, including, but not limited to matted prints or photos, screen, wallpaper on hardboard, acrylic, pegboard, dry-erase, chalkboard, magnetic or cork boards, minors, any variety of fabrics, or any variety of laminates, composites, or other designs or materials. Additionally, the less rigid or flaccid interchangeable panels 28 may be captured using friction fit spacers 20 as described herein above, or through other suitable means, such as through adhesion using Velcro, snaps, sewn-in friction fit spacers 20, or any other such means as known to one skilled in the art of coupling.

There are many possible uses for this system. The user may combine modular frames 10 and insert the friction fit spacers 20 and interchangeable panels 22, 24, 26, 28 to create a folding privacy screen for shared living or working areas, a decorative backdrop, to block sunlight or drafts, to direct foot traffic through interior spaces, or to form free-standing display cases or plant supports or growing supports using shelves 30. When desired, the entire portable partition system 100 may further be enclosed. If such an enclosure were transparent, portable partition system 100 might for exemplary purposes be used to form a small and collapsible green house or plant growth structure. As may be apparent, the flexibility created by the present apparatus is essentially without limit.

Decorative interchangeable panels 28 are easily changed by removing fabric panels and replacing them with different less rigid panels 28, or by removing friction fit spacers 20 and less rigid panels 28 and sliding rigid interchangeable panels 24, 26 into the grooves. The slide-in rigid panels 24, 26 and frames can be used to create a work space for a home, office, classroom or dorm room. Panels may be decorative (matted prints or photos, screen, wallpaper on hardboard, acrylic, etc) or functional (pegboard, dry-erase, chalkboard, magnetic or cork). They may be used to display artwork, photos, files, menus, sheet music, schedules, art or craft projects, etc. Pegboard panels may be painted or another decorative finish applied, and used to hang utensils, wall pockets, keys, jewelry, small items of clothing or accessories. When not in use, the frames may be easily folded and stored. The frame and panel partition is decorative, useful, portable and versatile.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

We claim:

1. A portable partition system which is readily adaptable in appearance and function, comprising:

a first longitudinally extensive upright having a longitudinally extensive groove therein;

a second longitudinally extensive upright having a longitudinally extensive groove therein, said first and second uprights spaced from each other and oriented with said second upright groove facing said first upright groove and defining a first panel space therebetween into which a decorative panel may be operatively inserted;

a first spacer at least partially inserted within, frictionally retained to and manually removable from said first upright groove;

a second spacer at least partially inserted within, frictionally retained to and manually removable from said second upright groove;

a first support bar spanning from said first upright to said second upright and manually removable therefrom, supported vertically by said first and second spacers, said first and second spacers and said first support bar defining an open space therebetween;

a small gap between said first upright groove and said first spacer; and a patch at least partially filling said small gap;

wherein said first spacer forms a friction fit with said first upright groove through friction induced there between by said patch.

2. The portable partition system which is readily adaptable in appearance and function of claim 1, further comprising a wall anchor pivotally coupled to said first longitudinally extensive upright.

3. The portable partition system which is readily adaptable in appearance and function of claim 1, wherein said support bar longitudinally extends from said first upright to said second upright, and further comprises at least one longitudinally extensive groove that cooperates with said first upright groove and said second upright groove to receive a rigid generally rectangular panel therein.

4. The portable partition system which is readily adaptable in appearance and function of claim 1, further comprising:

a third longitudinally extensive upright having a longitudinally extensive groove therein;

a fourth longitudinally extensive upright having a longitudinally extensive groove therein, said third and fourth uprights spaced from each other and oriented with said fourth upright groove facing said third upright groove and defining a second panel space therebetween into which a decorative panel may be operatively inserted;

a third spacer at least partially inserted within and manually removable from said third upright groove;

a fourth spacer at least partially inserted within and manually removable from said fourth upright groove;

a second support bar spanning from said third upright to said fourth upright and manually removable therefrom, supported vertically by said third and fourth spacers; and a hinge pivotally coupling said third upright to said first upright.

5. The portable partition system which is readily adaptable in appearance and function of claim 4, further comprising a shelf engaging, spanning between and supported by said first and second support bars.

6. The portable partition system which is readily adaptable in appearance and function of claim 1, wherein said patch further comprises a resilient pad.

7. The portable partition system which is readily adaptable in appearance and function of claim 6, wherein said resilient pad further comprises a loop fastener from a hook-and-loop fastener pair.

8. The portable partition system which is readily adaptable in appearance and function of claim 1, wherein said first support bar longitudinally extends from said first upright to said second upright, and further comprises at least one longitudinally extensive groove that cooperates with said first upright groove and said second upright groove to receive a rigid generally rectangular panel therein, and further comprising:

a third longitudinally extensive upright having a longitudinally extensive groove therein;

a fourth longitudinally extensive upright having a longitudinally extensive groove therein, said third and fourth uprights spaced from each other and oriented with said fourth upright groove facing said third upright groove and defining a second panel space therebetween into which a decorative panel may be operatively inserted;

a third spacer at least partially inserted within and manually removable from said third upright groove;

a fourth spacer at least partially inserted within and manually removable from said fourth upright groove;

a second support bar longitudinally extending from said third upright to said fourth upright and manually removable therefrom, supported vertically by said third and fourth spacers, and having at least one longitudinally extensive groove that cooperates with said third upright groove and said fourth upright groove to receive a rigid generally rectangular panel therein;

a hinge pivotally coupling said third upright to said first upright; and a shelf engaging and supported within said first and second support bar grooves and maintaining said first and second panel spaces in a fixed and non-coplanar angular relationship.

9. The portable partition system which is readily adaptable in appearance and function of claim 8, further comprising a plurality of uprights, shelves, and spacers forming a full circular circumference, the angular relationship between adjacent uprights fixed by said shelves.

10. The portable partition system which is readily adaptable in appearance and function of claim 1, further comprising:

a crossbar coupling a bottom of said first longitudinally extensive upright with a bottom of said second longitudinally extensive upright and defining a lower limit of said panel space;

a horizontal bar coupling a top of said first longitudinally extensive upright with a top of said second longitudinally extensive upright; and an opening extending vertically through said horizontal bar into said panel space and extending horizontally from said longitudinally extensive groove in said first longitudinally extensive upright to said longitudinally extensive groove in said second longitudinally extensive upright through which said decorative panel may operatively pass during said operative insertion.

11. A partition system, comprising:

a first longitudinally extensive upright having a longitudinally extensive groove therein;

a second longitudinally extensive upright having a longitudinally extensive groove therein, said first and second uprights spaced from each other and oriented with said second upright groove facing said first upright groove and defining a panel space therebetween into which a decorative panel may be operatively inserted;

a first spacer at least partially inserted within and manually removable from said first upright groove;

a second spacer at least partially inserted within and manually removable from said second upright groove;

a first support bar spanning from said first upright to said second upright and manually removable therefrom, supported vertically by said first and second spacers, and having at least one longitudinally extensive groove that cooperates with said first upright groove and said second upright groove to receive a rigid generally rectangular panel therein;

a third longitudinally extensive upright having a longitudinally extensive groove therein;

a fourth longitudinally extensive upright having a longitudinally extensive groove therein, said third and fourth uprights spaced from each other and oriented with said fourth upright groove facing said third upright groove and defining a panel space therebetween into which a decorative panel may be operatively inserted;

a third spacer at least partially inserted within and manually removable from said third upright groove;

a fourth spacer at least partially inserted within and manually removable from said fourth upright groove;

a second support bar longitudinally extending from said third upright to said fourth upright and manually removable therefrom, supported vertically by said third and fourth spacers, and having at least one longitudinally extensive groove that cooperates with said third upright groove and said fourth upright groove to receive a rigid generally rectangular panel therein;

a hinge pivotally coupling said third upright to said first upright;

a shelf engaging and supported within said first and second support bar grooves, the angular relationship between said third upright and said first upright fixed by the extent of arc of said shelf;

a small gap between said first upright groove and said first spacer; and a patch at least partially filling said small gap;

wherein said first spacer forms a friction fit with said first upright groove through friction induced therebetween by said patch.

12. The partition system of claim 11, further comprising a flaccid panel retained within said panel space and captured between said first spacer and said first upright groove.

13. The partition system of claim 11, further comprising a wall anchor pivotally coupled to said first longitudinally extensive upright.

14. The partition system of claim 11, wherein said patch further comprises a resilient pad.

15. The partition system of claim 14, wherein said resilient pad further comprises a loop fastener from a hook-and-loop fastener pair.

16. The partition system of claim 11, further comprising a plurality of uprights, shelves, and spacers forming a full circular circumference, the angular relationship between adjacent uprights fixed by said shelves.

* * * * *